US007276204B2

(12) United States Patent
Ebihara et al.

(10) Patent No.: US 7,276,204 B2
(45) Date of Patent: Oct. 2, 2007

(54) CARBURIZATION TREATMENT METHOD AND CARBURIZATION TREATMENT APPARATUS

(75) Inventors: Hisashi Ebihara, Tokyo (JP); Jun Takahashi, Tokyo (JP); Fumitaka Abukawa, Tokyo (JP); Keiji Yokose, Tokyo (JP); Hidetoshi Juryozawa, Tokyo (JP)

(73) Assignee: Dowa Thermotech Co., Ltd., Tokyo (JP)

( * ) Notice: Subject to any disclaimer, the term of this patent is extended or adjusted under 35 U.S.C. 154(b) by 0 days.

(21) Appl. No.: 10/107,449

(22) Filed: Mar. 28, 2002

(65) Prior Publication Data

US 2002/0179187 A1 Dec. 5, 2002

(30) Foreign Application Priority Data

Jun. 5, 2001 (JP) ..... 2001-169635

(51) Int. Cl.
*C21D 1/74* (2006.01)

(52) U.S. Cl. ..... 266/250; 266/252

(58) Field of Classification Search ..... 266/249, 266/250, 252; 148/216
See application file for complete search history.

(56) References Cited

U.S. PATENT DOCUMENTS 4,113,426 A * 9/1978 Rogers ..... 432/25
RE29,881 E * 1/1979 Westeren et al. ..... 148/223
4,622,006 A * 11/1986 Hohne ..... 266/259
5,702,540 A * 12/1997 Kubota ..... 148/223
5,722,825 A * 3/1998 Edenhofer ..... 266/251

FOREIGN PATENT DOCUMENTS

JP 06172960 A * 6/1994 ..... 148/216

OTHER PUBLICATIONS

English language translation of JP 06172960 A, Jun. 21, 1994.*

* cited by examiner

*Primary Examiner*—Scott Kastler
(74) *Attorney, Agent, or Firm*—Pillsbury Winthrop Shaw Pittman, LLP

(57) ABSTRACT

The invention provides a carburization treatment method in which a carburization treatment is conducted simultaneously with an operation of supplying a hydrocarbon gas and an oxidative gas into a furnace kept under a reduced pressure. Preferably, the internal pressure within the furnace is kept at 0.1 to 101 kPa, the hydrocarbon gas is one, two or more than two kinds of gases selected from the group consisting of $C_3H_8$, $C_3H_6$, $C_4H_{10}$, $C_2H_2$, $C_2H_4$, $C_2H_6$ and $CH_4$, while the oxidative gas is an air, an $O_2$ gas, or $CO_2$ gas.

4 Claims, 4 Drawing Sheets

| mm | average x |
|---|---|
| 0.01 | 0.765 |
| 0.05 | 0.746 |
| 0.1 | 0.741 |
| 0.2 | 0.713 |
| 0.3 | 0.662 |
| 0.4 | 0.594 |
| 0.5 | 0.520 |
| 0.6 | 0.439 |
| 0.7 | 0.363 |
| 0.8 | 0.309 |
| 0.9 | 0.258 |
| 1 | 0.229 |
| 1.1 | 0.216 |
| 1.2 | 0.210 |
| 1.3 | 0.202 |
| 1.4 | 0.201 |
| 1.5 | 0.196 |

| (mm) | average X |
|---|---|
| 0.01 | 0.819 |
| 0.05 | 0.833 |
| 0.1 | 0.832 |
| 0.2 | 0.798 |
| 0.3 | 0.729 |
| 0.4 | 0.626 |
| 0.5 | 0.539 |
| 0.6 | 0.453 |
| 0.7 | 0.381 |
| 0.8 | 0.306 |
| 0.9 | 0.264 |
| 1 | 0.250 |
| 1.1 | 0.220 |
| 1.2 | 0.210 |
| 1.3 | 0.208 |
| 1.4 | 0.188 |
| 1.5 | 0.197 |

CARBURIZATION TREATMENT METHOD AND CARBURIZATION TREATMENT APPARATUS

BACKGROUND OF THE INVENTION

1. Field of the Invention

The present invention relates to carburization treatment methods for carburizing steel material and a carburization treatment apparatus suitable for carrying out the carburization treatment methods.

2. Description of the Related Art

Various methods are known for carburizing steel material, such as a gas carburization method, a vacuum carburization method, and a plasma carburization method, with each having both advantages and disadvantages.

However, one gas carburization method has a disadvantage of the generation of a large amount of $CO_2$ gas and a possibility of an explosion. A further problem associated with this method is that intergranular oxidation will occur on the surface of the steel material. On the other hand, another gas carburization method using an endothermic gas makes it necessary to employ a metamorphism furnace, hence suffering from a problem of high equipment cost.

A vacuum carburization method is associated with a problem in that once the carbon concentration on the surface of a steel material is increased to a predetermined solid solubility, a large amount of soot will be undesirably generated. As a result, not only does the carburization equipment need a comparatively long time and a considerably high cost for maintenance, but also such equipment does not have sufficient versatility. Moreover, another problem associated with this method is that it is difficult to perform a carbon potential control in an atmosphere within the furnace, if compared with the above-described gas carburization methods. In addition, a plasma carburization method is said to be low in productivity.

SUMMARY OF THE INVENTION

Accordingly, it is an object of the present invention to provide improved, new and economical carburization treatment methods which can be effectively used to replace any one of the above-described conventional carburization methods. It is another object of the present invention to provide an improved carburization treatment apparatus which is suitable for carrying out the carburization treatment methods provided according to the present invention.

In order to achieve the above objects of the present invention, a carburization treatment method according to the present invention comprises performing the carburization treatment while supplying a hydrocarbon gas and an oxidative gas into a furnace kept at a reduced pressure.

With the use of the present invention, since it is possible to dispense with an exhaust gas burning process (which was needed in the above-described conventional gas carburization method), the $CO_2$ gas generation amount can be reduced so as to reduce an explosion possibility. Further, since it is not necessary to employ a metamorphism furnace, the amount of gas necessary to be used in the carburization treatment can be reduced, thereby rendering the whole process of carburization treatment more economical. Moreover, different from the above-described vacuum carburization method, since the method of the invention makes it possible to supply not only the hydrocarbon gas but also an oxidative gas, and since it is possible to control the carbon potential of the atmosphere within the furnace, the generation of soot can be prevented, thereby rendering easier the maintenance of the furnace.

As a preferred embodiment of the present invention, the carburization treatment is conducted while supplying a hydrocarbon gas and an oxidative gas, and an inert gas is further supplied during the carburization treatment. With the use of this method, it is possible to increase the gas amount within the furnace, thereby making it possible to ensure a uniform temperature rise and thus a uniform carburization treatment.

Further, as another embodiment of the present invention, it is preferable that the internal pressure within the furnace is 0.1 to 101 kPa. In other words, if the internal pressure within the furnace is lower than 0.1 kPa, it is impossible to ensure a desired carburization capability. On the other hand, if the internal pressure within the furnace is larger than 101 kPa, since such an internal pressure is generally close to atmospheric pressure, a problem will be caused which is similar to that associated with the above-described conventional gas carburization method.

Furthermore, in the above-described method according to the present invention, the hydrocarbon gas may be at least one selected from the group consisting of $C_3H_8$, $C_3H_6$, $C_4H_{10}$, $C_2H_2$, $C_2H_4$, $C_2H_6$ and $CH_4$, while the oxidative gas may be air, $O_2$ gas or $CO_2$ gas.

Moreover, in the method according to the present invention, a carbon potential of the atmosphere within the furnace is controlled by controlling the amount of at least one of the hydrocarbon gas and the oxidative gas. At this time, the amount of at least one of the hydrocarbon gas and the oxidative gas is controlled by carrying out at least one of the following measurements which include: measurement of CO gas partial pressure, measurement of CO gas concentration, measurement of $CO_2$ gas partial pressure, measurement of $CO_2$ gas concentration, measurement of $O_2$ gas partial pressure, measurement of $O_2$ gas concentration, measurement of $H_2$ gas partial pressure, measurement of $H_2$ gas concentration, measurement of $CH_4$ gas partial pressure, measurement of $CH_4$ gas concentration, measurement of $H_2O$ partial pressure, measurement of $H_2O$ concentration, and measurement of a dew point, all within the furnace.

On the other hand, a carburization treatment apparatus according to the present invention comprises a hydrocarbon gas supply unit for supplying a hydrocarbon gas into a furnace; an oxidative gas supply unit for supplying an oxidative gas into the furnace; and a vacuum pump for reducing the internal pressure within the furnace. With the use of the carburization treatment apparatus according to the present invention, it is possible to carry out the above-described method of the present invention with a high efficiency. In contrast, a conventional gas carburization furnace is not associated with the use of a vacuum pump, and a conventional vacuum carburization furnace does not contain an oxidative gas supply unit since it is not needed.

The above carburization treatment apparatus further comprises an in-furnace atmosphere analyser for analysing the atmosphere within the furnace, and a pressure gauge to control the internal pressure within the furnace. With the use of such a carburization treatment apparatus, it is possible to correctly control the atmosphere within the furnace, and also to control and thus reduce the internal pressure within the furnace, thereby rendering it possible to more effectively carry out the above-described method of the present invention.

In addition, the above-described carburization treatment apparatus further comprises a computing device for computing a carbon potential in accordance with an analysis value fed from the in-furnace atmosphere analyzer, a regulation device for regulating the amount of at least one of the hydrocarbon gas and the oxidative gas in accordance with the computed values fed from the computing device, and a thermo-couple for controlling the internal temperature within the furnace. With the use of this carburization treatment apparatus, it is possible to automatically supply the hydrocarbon gas and/or the oxidative gas into the furnace, and it is also possible to control the internal temperature of the furnace.

Moreover, in the above-described carburization treatment apparatus, the in-furnace atmosphere analyzer is at least one of the following gauges and meters including CO gas partial pressure gauge, CO gas concentration meter, $CO_2$ gas partial pressure gauge, $CO_2$ gas concentration meter, $O_2$ gas partial pressure gauge, $O_2$ gas concentration meter, $H_2$ gas partial pressure gauge, $H_2$ gas concentration meter, $CH_4$ gas partial pressure gauge, $CH_4$ gas concentration meter and dew point hygrometer.

DESCRIPTION OF THE PREFERRED EMBODIMENTS

Figure 1:
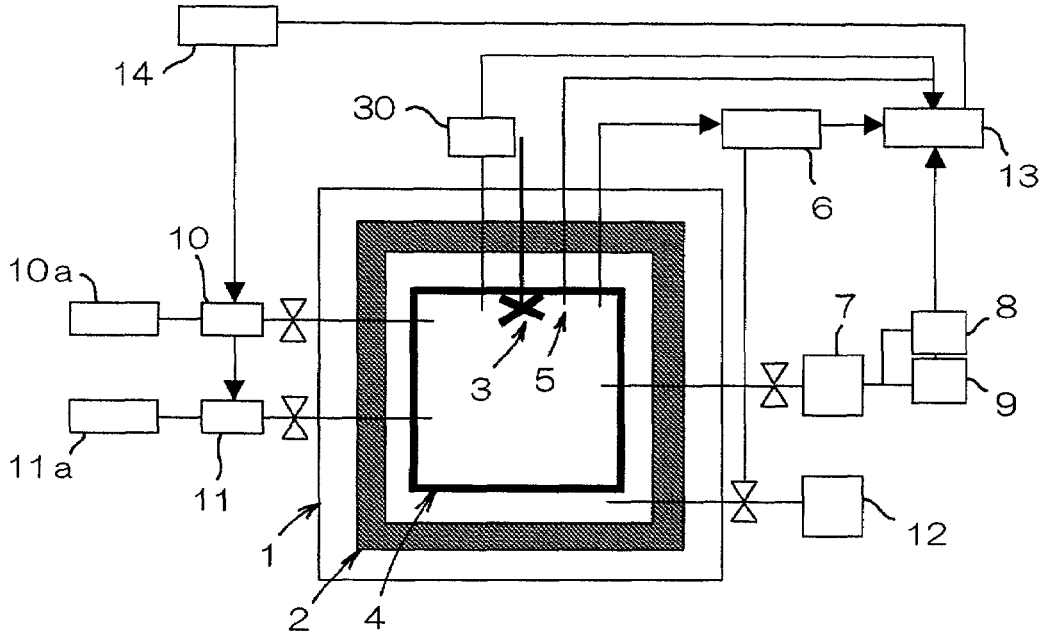
FIG. 1 is an explanatory view showing a carburization furnace suitable for carrying out the carburization treatment method according to the present invention.

Referring to FIG. 1, reference numeral 1 represents a furnace casing, reference numeral 2 represents a thermally insulating material, reference numeral 3 represents an atmosphere stirring fan, reference numeral 4 represents a heater, reference numeral 5 represents a thermal couple for measuring an internal temperature within the furnace, reference numeral 6 represents a pressure gauge for use in controlling and reducing an internal pressure within the furnace, reference numeral 7 represents a sampling device for sampling an atmosphere within the furnace, reference numeral 8 represents an analyzer for analyzing an atmosphere within the furnace, such an analyzer may be a CO gas partial pressure gauge or a CO gas concentration meter. Reference numeral 9 represents an analyzer for analyzing an atmosphere within the furnace, but such an analyzer may be a $CO_2$ gas partial pressure gauge or a $CO_2$ gas concentration meter. Reference numeral 30 represents a further analyzer for analyzing an atmosphere within the furnace, such an analyzer may be an $O_2$ gas partial pressure gauge or an $O_2$ gas concentration meter. Reference numeral 10 represents a mass flow controller provided in connection with a hydrocarbon gas supply unit 10*a* for controlling an amount of hydrocarbon gas to be supplied to the furnace. Reference numeral 11 represents another mass flow controller provided in connection with an oxidative gas supply unit 11*a* for controlling an amount of an oxidative gas to be supplied to the furnace. Reference numeral 12 represents a vacuum pump for reducing an internal pressure within the furnace. Reference numeral 13 represents a carbon potential computing device, reference numeral 14 represents a regulation device for sending regulation signals to the mass flow controllers 10 and 11 in accordance with the computed values fed from the carbon potential computing device 13. Here, the thermally insulating material 2 is preferably made of a ceramic fiber having a low heat radiation and a low heat accumulation.

With regard to the aforementioned carburization furnace having the above-described construction, the pressure reduction adjustment within the furnace can be carried out by controlling the discharge of an atmosphere from the furnace, by virtue of the pressure gauge 6 and the vacuum pump 12. Further, the carbon potential of an atmosphere within the furnace may be controlled in a manner described as follows, so that it is possible to maintain a high carbon potential which is slightly below a carbon solid solubility. At this time, the analysis values fed from the internal atmosphere analyzers 8, 9 and 30 are introduced into the carbon potential computing device 13. Then, the adjustment gauge 14, in accordance with the computed values provided by the carbon potential computing device 13, operates to send an adjustment signal to the mass flow controller 10 (for controlling the hydrocarbon gas supply amount) as well as to the mass flow controller 11 (for controlling the oxidative gas supply amount). In this way, it is possible to adjust an amount of at least one of the hydrocarbon gas and the oxidative gas being supplied into the furnace, thereby effectively controlling the carbon potential of an atmosphere within the furnace.

The control of an amount of the hydrocarbon gas and/or the oxidative gas being supplied into the furnace may be effected by measuring the partial pressure of at least one of various kinds of gases forming an atmosphere within the furnace. However, it is also possible to perform the same control by measuring the concentration of at least one of various kinds of gases forming the atmosphere within the furnace. For example, it is possible to measure the partial pressure or the concentration of at least one of CO gas, $CO_2$ gas, $O_2$ gas, $H_2$ gas and $CH_4$ gas (together forming an atmosphere within the furnace), by utilizing various partial pressure gauges (CO gas partial pressure gauge, $CO_2$ gas partial pressure gauge, $O_2$ gas partial pressure gauge, $H_2$ gas partial pressure gas and $CH_4$ gas partial pressure gas) or various concentration meters (CO gas concentration meter, $CO_2$ gas concentration meter, $O_2$ gas concentration meter, $H_2$ gas concentration meter and $CH_4$ gas concentration meter), thereby effecting correct control of the supply amount of the hydrocarbon gas and/or the oxidative gas when being supplied into the furnace.

Furthermore, it is possible to control an amount of the hydrocarbon gas and/or the oxidative gas being supplied into the furnace, by measuring the partial pressure of $H_2O$ or the concentration of $H_2O$ within the furnace, or by measuring the dew point of an atmosphere gas within the furnace using a dew point hygrometer.

In this way, with the use of the various methods as described in the above, it is possible to correctly control an amount of the hydrocarbon gas and/or the oxidative gas being supplied into the furnace, thereby making it possible to keep an atmosphere within the furnace at a high carbon potential which is slightly below the carbon solid solubility.

Figure 2:
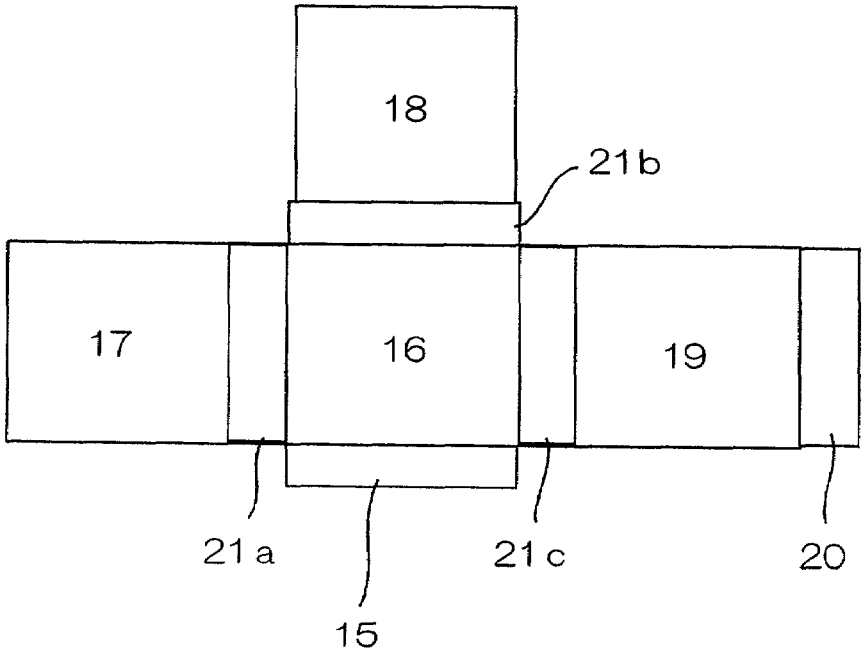
FIG. 2 is a plan view showing the structure of a carburization quenching apparatus suitable for carrying out the carburization treatment method according to the present invention.

Referring to FIG. 2, reference numeral 15 represents an inlet door, reference number 16 represents a transportation room, reference numeral 17 represents a carburization room, reference numeral 18 represents a gas cooling room, reference numeral 19 represents an oil quenching room, reference numeral 20 represents an outlet door, while reference numerals 21*a*, 21*b* and 21*c* all represent partition doors. Here, the carburization room 17 is identical to the carburization room in the carburization furnace shown in FIG. 1.

An initial state of the carburization quenching apparatus will be described as follows. Namely, the inlet door 15, the outlet door 20 and the partition doors 21*a*, 21*b* and 21*c* are all closed. The carburization room 17 is heated to a quenching temperature and then kept at this temperature, while the pressure within the carburization room is controlled at 0.1 kPa or lower. Similarly, the pressure within the quenching room 19 is also kept at 0.1 kPa or lower, while the quenching oil within the quenching room 19 is heated to a temperature suitable for steel material quenching treatment. At this time, the transportation room 16 is under atmospheric pressure.

Starting from the above-described initial state, at first, the inlet door 15 is opened so that steel material is introduced into the transportation room 16. Then, the inlet door 15 is closed and the pressure within the transportation room 16 is reduced to 0.1 kPa or lower. Subsequently, the partition door 21*a* located between the transportation room 16 and the carburization room 17 is opened so that the steel material is moved to the carburization room 17. Then, the partition wall 21 is closed. On the other hand, although not shown in the drawings, an apparatus for transporting the steel material may be a chain device (for use in the transportation room 16 as well as in the oil quenching room 19 and driven by a motor, and may also be a roller hearth for use in the carburization room 17).

Then, after the partition door 21*a* is closed, the pressure within the carburization room 17 recovers to a predetermined pressure such as 100 kPa by virtue of $N_2$ gas, while the temperature within the carburization room is elevated to the carburization temperature. Subsequently, after the carburization room has been kept at the carburization temperature for 30 minutes, $N_2$ gas is discharged from the carburization room 17, so that the pressure within the carburization room 17 is reduced to 0.1 kPa or lower.

Afterwards, a predetermined amount of hydrocarbon gas and a predetermined amount of oxidative gas are supplied to the carburization room 17 by way of a purge line, so that an internal pressure within the carburization room 17 is allowed to be restored to its carburization pressure. Upon pressure restoration and based on the computation result obtained by processing the data representing the measured $CO_2$ partial pressure or $CO_2$ concentration, the carburization room 17 is allowed to control, with the use of a control line, the supply amount of at least one of the hydrocarbon gas and the oxidative gas. However, at this time, the carbon potential is set with reference to a carbon solid solubility which depends on a carburization temperature, so that such a carbon potential will be within a predetermined range so as not to produce soot.

After having performed the carburization treatment for a predetermined time period, the supply of the hydrocarbon gas as well as the oxidative gas to the carburization room 17 is stopped, and the atmosphere within the carburization room 17 is discharged so as to have the steel material kept under a reduced pressure, thereby adjusting the carbon concentration on the surface of the steel material. Then, the temperature within the carburization room 17 is lowered to the quenching temperature, and the partition door 21*a* is opened. Further, the partition door 21*c* located between the transportation room 16 and the quenching room 19 is opened, so that the steel material is transferred, under a reduced pressure, to the quenching room 19 by way of the transportation room 16, thereby performing an oil quenching treatment. After the quenching treatment, the steel material is taken out of the treatment system by way of the outlet door 20. At this moment, an adjustment of the carbon concentration on the surface of the steel material is allowed to be performed, and at the same time a control of the quenching temperature is carried out.

Furthermore, in the case of a high temperature carburization treatment (1050° C.) which requires an adjustment of crystal particles, after an adjustment has been performed on the carbon concentration on the surface of the treated steel material, the steel material is transported to the gas cooling room 18 by way of the transportation room 16 as well as the partition door 21*b*. Then, after the pressure has been restored to a predetermined value (for example, 100 kPa) by means of $N_2$ gas, the steel material is cooled and the $N_2$ gas is discharged, so that the pressure over the steel material is reduced to 1 kPa or lower. In this way, under a reduced pressure and by way of the transportation room 16, the steel material is returned to the carburization room 17 so as to be heated again to a temperature suitable for a reheating treatment. Moreover, the carburization room 17 is kept at the reheating temperature for 30 minutes. Then, the $N_2$ gas is discharged so that the pressure within the carburization room is reduced to 1 kPa or lower. Subsequently, the steel material is transported to the quenching room 19 by way of the transportation room 16, thereby performing an oil quenching treatment. In this way, after the quenching treatment has been finished, the steel material is taken out of the treatment system by way of the outlet door 20.

In fact, the inventors of the present invention have conducted the carburization treatment using the method of the present invention, with an actual process and results thereof being discussed in the following.

EXAMPLE 1

Sections of steel material SCM 420 in the form of test pieces each having a diameter of 20 mm and a length of 40 mm were disposed at nine positions (upper and lower corner portions as well as in the central area) within the carburization room 17 whose internal temperature was controlled at 950° C. and whose internal pressure was controlled at 0.1 kPa or lower. Then, the pressure within the carburization room 17 was restored to 100 kPa by charging the room with $N_2$ gas, while the internal temperature thereof was kept at 950° C.

After the carburization room 17 had been kept under the above-described conditions for 30 minutes, its internal pressure was reduced to 0.1 kPa by virtue of gas discharge. Subsequently, $C_3H_8$ gas and $CO_2$ gas were supplied into the carburization room 17, each at a flow rate of 3.5 L/min so as to increase the internal pressure to 1.7 kPa.

Next, with the internal pressure of the carburization room 17 kept at 1.7 kPa, the amount of $C_3H_8$ gas and/or $CO_2$ gas being supplied to the carburization room was changed so as to control the carbon potential to 1.25%. Then, the interior of the carburization room 17 was kept at 950° C. for 57 minutes.

Subsequently, the supply of $C_3H_8$ gas and/or $CO_2$ gas was stopped and the internal pressure within the carburization room 17 was reduced to 0.1 kPa by virtue of gas discharge. Then, this internal pressure was kept for 37 minutes, while the internal temperature of the carburization room 17 was lowered to 870° C. during a subsequent time period of 30 minutes. Then, the steel material was transported to the quenching room 19 by way of the transportation room 16, thereby starting the oil quenching treatment.

Figure 3:
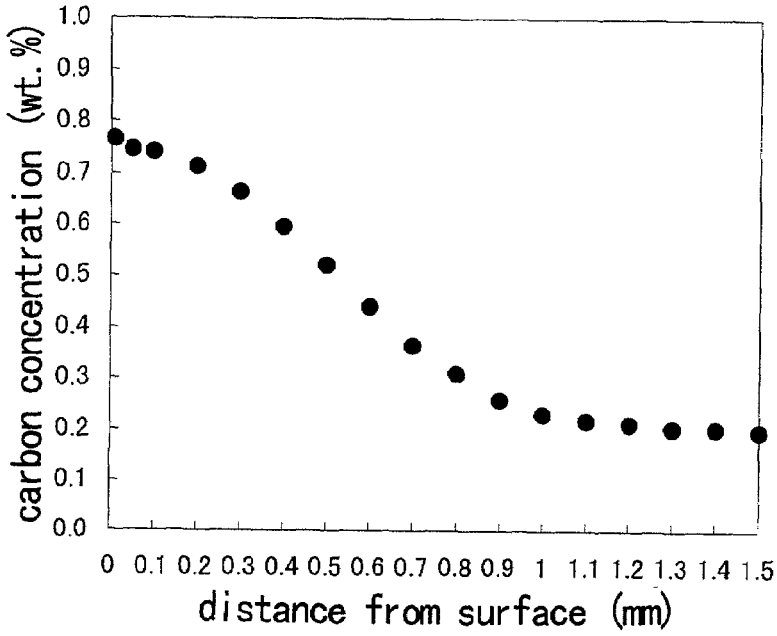
FIG. 3 is a graph showing an average carbon concentration distribution of a steel material treated in Example 1.
Figure 4:
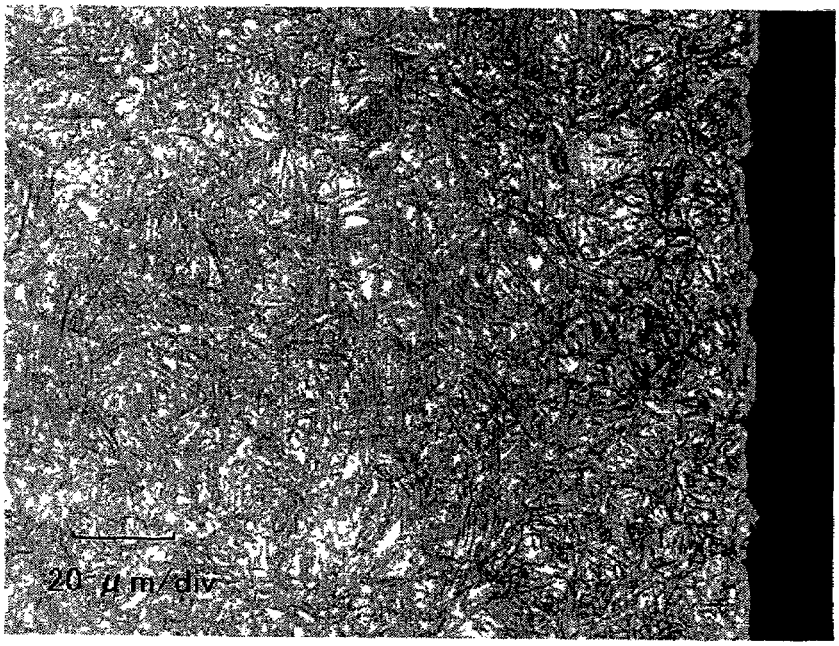
FIG. 4 is a photograph showing the surface organization of the steel material treated in Example 1.

The average carbon concentration distribution of the steel material treated in this example is shown in FIG. 3. In fact, the carbon concentrations shown in this graph represent the average values of the carbon concentrations of the steel material pieces located at the aforementioned nine positions. As a result, an effective carburization depth (0.36% C) could be found to be 0.7 mm, which was an appropriate value. Further, a photograph representing the surface organization of the treated steel material is shown in FIG. 4. It is to be noted that there were no abnormal layers formed on the surface of the steel material treated in the above described process.

When a carburization lead time of the carburization treatment in Example 1 was compared with a carburization lead time of the gas carburization treatment (which is a conventional process) using an endothermic gas, it was found that the conventional gas carburization treatment using an endothermic gas needed 118 minutes as its carburization lead time, while the carburization lead time of the carburization treatment in Example 1 was only 94 minutes, thus making it possible to shorten the carburization lead time by about 20%. In this way, using the carburization treatment method actually carried out in Example 1, it becomes possible to obtain a carburized layer having a desired depth using a shorter time period than required by the above described conventional gas carburization treatment (which requires the use of an endothermic gas). Therefore, the total energy consumption can be reduced and thus the desired economic advantage can be achieved. Moreover, since there is no soot being generated, the pieces of steel material can be placed at any position within the furnace without any limitation. In addition, the use of the present invention makes it possible to obtain carburized layers which are relatively uniform and differ little from each other in their physical and chemical properties.

EXAMPLE 2

Example 2 is used to explain how a high temperature carburization can be carried out. Namely, sections of steel material pieces which were identical to those used in Example 1 were disposed at nine positions within the carburization room 17 whose internal temperature was controlled at 1050° C. and whose internal pressure was controlled at 0.1 kPa or lower. Then, the pressure within the carburization room 17 was restored to 100 kPa by charging the room with $N_2$ gas, while the internal temperature thereof was kept at 1050° C.

After the carburization room 17 had been kept under the above-described conditions for 30 minutes, its internal pressure was reduced to 0.1 kPa by virtue of gas discharge.

Subsequently, $C_3H_8$ gas and $CO_2$ gas were supplied into the carburization room 17 at a flow rate of 14 L/min so as to increase the internal pressure to 1.7 kPa.

Next, with the internal pressure of the carburization room 17 kept at 1.7 kPa, the supply amount of $CO_2$ gas was controlled at a constant flow rate of 10 L/min, while the supply amount of $C_3H_8$ gas was changed so as to have the carbon potential controlled at 1.4%. Then, the interior of the carburization room 17 was kept at 1050° C. for 16 minutes.

Subsequently, the supply of $C_3H_8$ gas and $CO_2$ gas was stopped and the internal pressure within the carburization room 17 was reduced to 0.1 kPa by virtue of gas discharge. This internal pressure was kept for 16 minutes. Afterwards, the steel material was cooled and then heated again so as to adjust the size of the crystal particles.

In more detail, the steel material was transported from the carburization room 17 to the gas cooling room 18 by way of the transportation room 16. Then, the interior of the gas cooling room 18 was restored to 100 kPa by charging the room with $N_2$ gas, followed by cooling the same for 15 minutes. Afterwards, the $N_2$ gas was discharged and the internal pressure within the gas cooling room 18 was reduced to 0.1 kPa or lower. At this time, the steel material was transported into the carburization room 17 by way of the transportation room 16. Then, the steel material was heated so as to increase its temperature, with the heating process being conducted under a condition in which the $N_2$ gas was still present and the internal pressure within the carburization room was 100 kPa. After this condition had been kept for 30 minutes, the internal pressure within the carburization room 17 was reduced to 0.1 kPa by virtue of gas discharge, while the steel material was transported to the quenching room 19 by way of the transportation room 16, thereby starting the oil quenching treatment.

Figure 5:
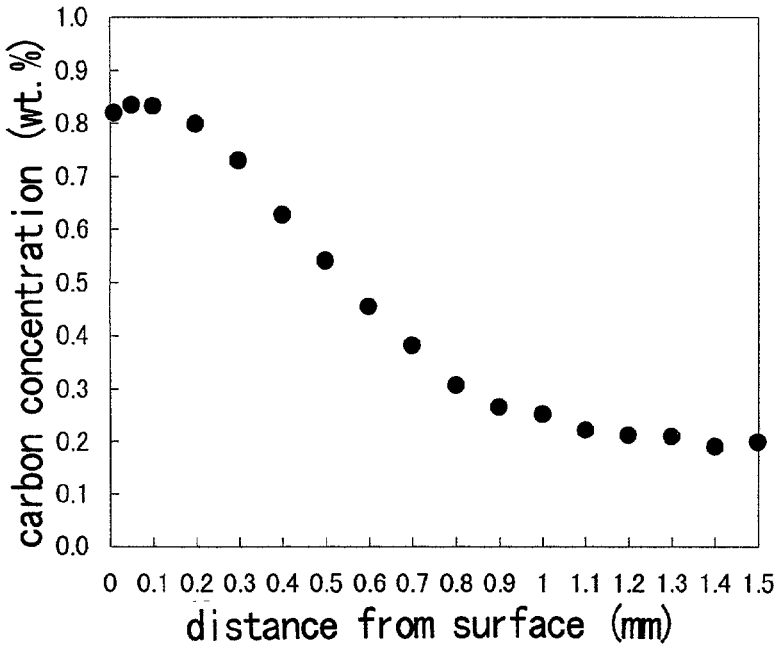
FIG. 5 is a graph showing an average carbon concentration distribution of a steel material treated in Example 2.
Figure 6:
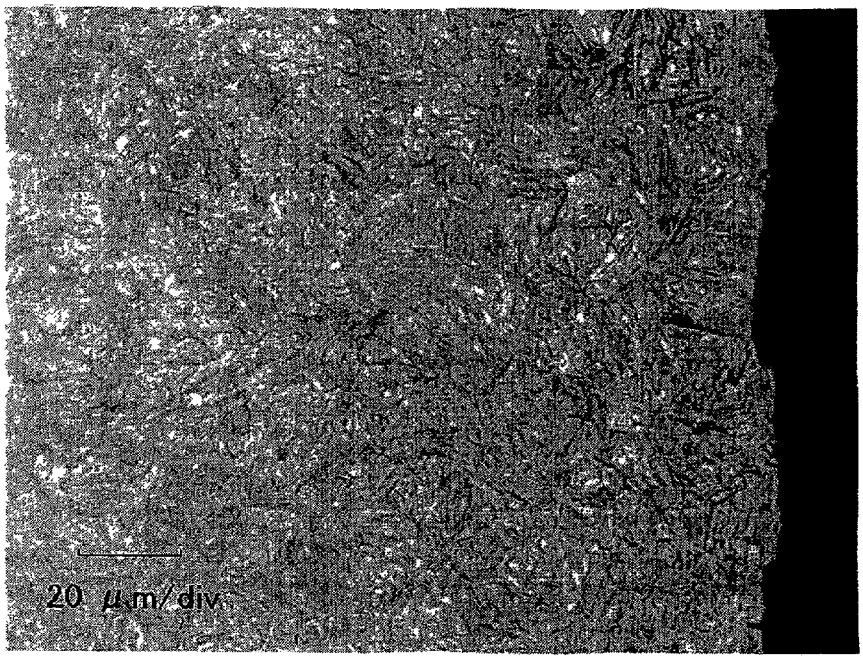
FIG. 6 is a photograph showing the surface organization of the steel material treated in Example 2.
Figure 7:
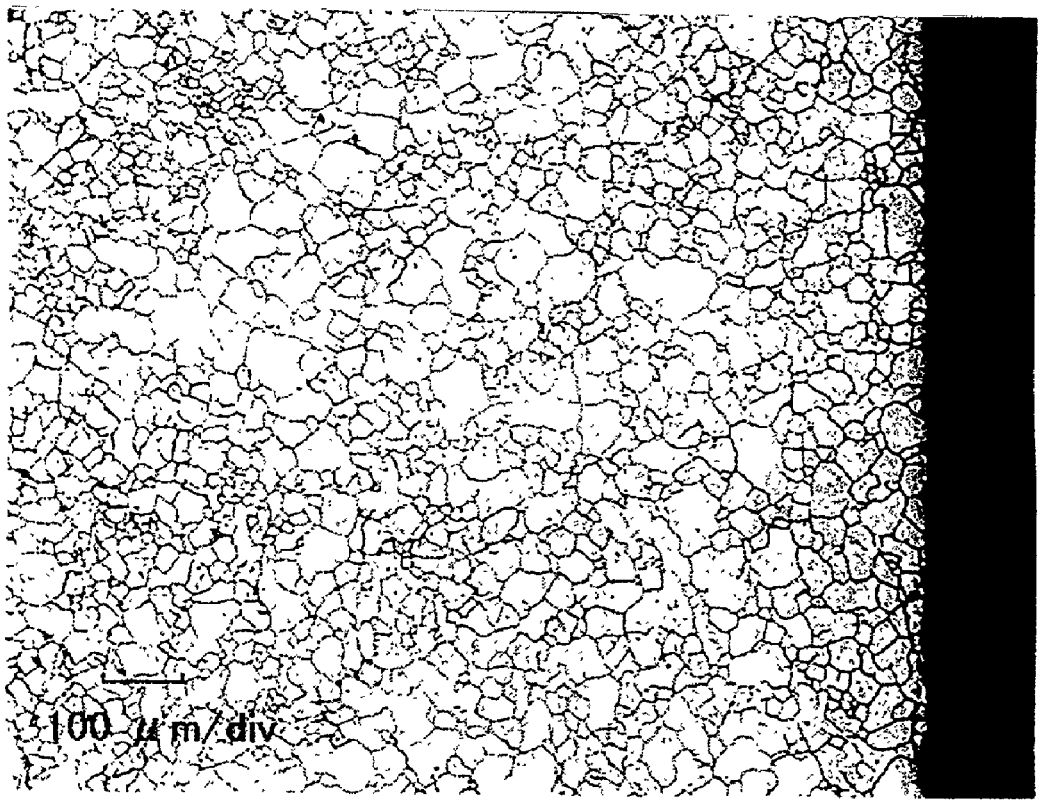
FIG. 7 is also a photograph but showing the crystal particles of the steel material treated in Example 2.

The average carbon concentration distribution of the steel material treated in this example is shown in FIG. 5. In fact, similar to the above example shown in FIG. 3, the carbon concentrations shown in this graph represent the average values of the carbon concentrations of the steel material pieces located at the aforementioned nine positions. As a result, an effective carburization depth (0.36% C) was found to be 0.73 mm, which was an appropriate value. Further, a photograph indicating the surface organization of the treated steel material is shown in FIG. 6. It is to be noted that there were no abnormal layers formed on the surface of the steel material treated in the above described process. In addition, one example of a crystal particle photograph is shown in FIG. 7. Here, the crystal particle size was #9, which was an appropriate value.

In this way, since the treatment temperature was set at 1050° C., which is a high temperature, and since the carbon potential was set at 1.4%, the carburization lead time of the carburization treatment in Example 2 could be greatly reduced. In fact, the carburization lead time in this example was reduced by about 73% compared with the aforementioned conventional gas carburization treatment (which uses an endothermic gas). Accordingly, using the carburization treatment method actually carried out in Example 2, it becomes possible to obtain a carburized layer having a desired depth, using a reduced time period than that required by the above described conventional gas carburization treatment (which uses an endothermic gas). Therefore, it is possible to reduce the total energy consumption. Moreover, since there is no soot being generated, the pieces of steel material can be placed at any position within the furnace without any limitation. In this way, the use of the present invention makes it possible to obtain carburized layers which are relatively uniform and differ little from each other in their physical and chemical properties.

EXAMPLE 3

Example 3 was conducted based on Example 1 but using a different carburization pressure from that used in Example 1. Namely, sections of steel material pieces which were identical to those used in Example 1 were disposed at nine positions within the carburization room 17 whose internal temperature was controlled at 950° C. and whose internal pressure was controlled at 0.1 kPa or lower. Then, the pressure within the carburization room 17 was restored to 100 kPa by charging the room with $N_2$ gas, while the internal temperature thereof was kept at 950° C.

After the carburization room 17 had been kept under the above described conditions for 30 minutes, its internal pressure was reduced to 0.1 kPa by virtue of gas discharge. Subsequently, $C_3H_8$ gas and $CO_2$ gas were supplied into the carburization room 17, each at a flow rate of 15 L/min so as to increase the internal pressure to 100 kPa.

Next, with the internal pressure of the carburization room 17 kept at 100 kPa, the supply amount of $CO_2$ gas and/or the supply amount of $C_3H_8$ gas were changed so as to have the carbon potential controlled at 1.25%. Then, the interior of the carburization room 17 was kept at 950° C. for 57 minutes.

Subsequently, the supply of $C_3H_8$ gas and $CO_2$ gas was stopped and the internal pressure within the carburization room 17 was reduced to 0.1 kPa by virtue of gas discharge. Then, this internal pressure was kept for 37 minutes, while the internal temperature of the carburization room 17 was lowered to 870° C. during a subsequent time period of 30 minutes. Afterwards, the steel material was transported to the quenching room 19 by way of the transportation room 16, hence starting the oil quenching treatment.

As a result, an effective carburization depth (0.36% C) of the treated steel material in this example was found to be 0.72 mm, which was an appropriate value, and no soot was generated.

What is claimed is:

1. A carburization treatment apparatus, comprising:

a transportation room;

a carburization room adjacent to the transportation room; and a quenching room adjacent to the transportation room;

a gas cooling room adjacent to the transportation room;

said carburization room including:

a hydrocarbon gas supply unit for supplying a hydrocarbon gas into the carburization room;

an oxidative gas supply unit for supplying an oxidative gas into the carburization room;

a vacuum pump for reducing an internal pressure of the carburization room;

an in-furnace atmosphere analyzer for analyzing an atmosphere within the carburization room;

a pressure gauge for controlling the internal pressure of the carburization room;

a thermocouple for controlling the internal temperature of the carburization room;

a computing device for computing a carbon potential in accordance with analysis values fed from the in-furnace atmosphere analyzer, the pressure gauge, and the thermocouple; and a regulation device for regulating an amount of at least one of said hydrocarbon gas and said oxidative gas in accordance with a computed value fed from the computing device, wherein for steel material to move from one of said carburization room, said quenching room and said gas cooling room to another of said carburization room, said quenching room and said gas cooling room, the steel material must traverse said transportation room, and wherein a pressure within at least said carburization room, said gas cooling room and said transportation room is controlled to at least 0.1 kPa.

2. The carburization treatment apparatus according to claim 1, wherein the in-furnace atmosphere analyzer is at least one selected from the group consisting of a CO gas partial pressure gauge, a CO gas concentration meter, a CO2 gas partial pressure gauge, a CO2 gas concentration meter, an O2 gas partial pressure gauge, an O2 gas concentration meter, a H2 gas partial pressure gauge, a H2 gas concentration meter, a CH4 gas partial pressure gauge, a CH4 gas concentration meter, and a dew point hygrometer.

3. The carburization treatment apparatus according to claim 1, further comprising a N2 gas inlet for supplying a N2 gas into the carburization room.

4. A carburization treatment apparatus, comprising:

a hydrocarbon gas supply unit for supplying a hydrocarbon gas into a carburization room;

an oxidative gas supply unit for supplying an oxidative gas into the carburization room;

a vacuum pump for reducing an internal pressure of the carburization room;

an in-furnace atmosphere analyzer for analyzing an atmosphere within the carburization room;

a pressure gauge for controlling the internal pressure of the carburization room;

a thermocouple for controlling the internal temperature of the carburization room;

a computing device for computing a carbon potential in accordance with analysis values fed from the in-furnace atmosphere analyzer, the pressure gauge, and the thermocouple; and a regulation device for regulating an amount of at least one of said hydrocarbon gas and said oxidative gas in accordance with a computed value fed from the computing device.

* * * * *